US007868770B2

(12) United States Patent
Al-Mutairi

(10) Patent No.: US 7,868,770 B2
(45) Date of Patent: Jan. 11, 2011

(54) WARNING DEVICE FOR DRIVERS AND THE LIKE

(76) Inventor: Sami H. Al-Mutairi, Block 10, Street 7, House 5, Kuwait-Khaitan (KW)

( * ) Notice: Subject to any disclaimer, the term of this patent is extended or adjusted under 35 U.S.C. 154(b) by 173 days.

(21) Appl. No.: 11/939,687

(22) Filed: Nov. 14, 2007

(65) Prior Publication Data

US 2009/0121882 A1 May 14, 2009

(51) Int. Cl.
*G08B 23/00* (2006.01)

(52) U.S. Cl. ..... 340/575; 340/576; 340/439; 340/573.1

(58) Field of Classification Search ..... 340/575, 340/573, 576, 573.1, 439; 364/413
See application file for complete search history.

(56) References Cited

U.S. PATENT DOCUMENTS 3,045,225 A * 7/1962 Baldwin ..... 340/575
3,626,128 A * 12/1971 Du Rocher et al. ..... 200/194
4,177,460 A * 12/1979 Hoinski et al. ..... 340/576
4,644,330 A * 2/1987 Dowling ..... 340/575
5,455,566 A * 10/1995 Conway ..... 340/573.1
5,488,354 A * 1/1996 Bobby ..... 340/576
5,508,685 A * 4/1996 Monte, Jr. ..... 340/576
5,568,127 A * 10/1996 Bang ..... 340/575
5,939,989 A * 8/1999 Bang ..... 340/575
5,990,795 A * 11/1999 Miller ..... 340/576
6,016,103 A * 1/2000 Leavitt ..... 340/575
6,270,466 B1 * 8/2001 Weinstein et al. ..... 600/590
6,894,606 B2 * 5/2005 Forbes et al. ..... 340/435
2001/0031930 A1 * 10/2001 Roizen et al. ..... 600/544
2003/0107489 A1 * 6/2003 Li ..... 340/575
2007/0080812 A1 * 4/2007 Perlman ..... 340/573.1
2009/0108382 A1 * 4/2009 Eriksen et al. ..... 257/419

* cited by examiner

*Primary Examiner*—Benjamin C Lee
*Assistant Examiner*—Quang Pham
(74) *Attorney, Agent, or Firm*—Lowe Hauptman Ham & Berner, LLP

(57) ABSTRACT

A warning device for alerting an individual of a tendency to fall asleep includes a pressurized collar adapted to fit around an individual's neck with an operable portion of the collar under the individual's chin and in close proximity thereto. A pressure sensor and an alarm are provided to sense an increase in pressure due to the individual's chin pressing against the collar and sound an alarm in response to the increase in pressure. The alarm may be audible or tactile.

3 Claims, 5 Drawing Sheets

WARNING DEVICE FOR DRIVERS AND THE LIKE

FIELD OF THE INVENTION

The invention relates to a warning device for drivers and the like and more particularly to a warning device for alerting an individual of a tendency to fall asleep.

BACKGROUND FOR THE INVENTION

One of the hazards of driving motor vehicles such as automobiles, trucks and buses is that of accidentally falling asleep. The problem is particularly serious for over the road trucks and others who must drive long distances on interstate highways at all hours of the day and night. The problem is exacerbated by boring stretches where there is little or nothing of interest and a driver rivets his/her eyes on the road for hour after hour without a break A type of sleep attributed to driving and particularly long-distance driving is not the deep sleep of normal rest, but rather a form of auto hypnosis which has been defined as a state of intense reverie. It can result from prolonged fixation of sight or boredom or fixation of attention on a single relatively monogamous subject such as the hum of tire treads or sound of the motor. A tendency to doze off during such periods is often intensified by fatigue or lack of sleep.

Whatever the problem, a tendency to doze off while operating a motor vehicle can lead to a tragic result for a driver and/or innocent third parties. For this reason, there have been numerous approaches to provide an alarm that can be utilized by the driver to inhibit sleeping while at the wheel of the motor vehicle.

For example, a U.S. Pat. No. 2,711,528 of Glossbrenner, discloses a relatively simple waking alarm for vehicle operators. The patent discloses a light weight device comprising a first electrical contact supported in a motor vehicle in spaced relation to the head of the operator. The contact is connected to a circuit of an electrically actuated horn. A second electrical contact member is carried by the drivers head. Then, when the drivers head is moved out of its normal position or range of normal positions, the first contact engages the second contact member to sound the vehicle's horn and awaken the driver.

A more recent approach to a sleep preventing device is disclosed in the U.S. Pat. No. 3,045,225 of Baldwin. As disclosed therein, a noise making device automatically sounds a warning when the head of a user nods forwardly. Another approach to a drowsiness detecting apparatus is disclosed in the U.S. Pat. No. 4,144,531 of Anbergen. Anbergen discloses an apparatus for detecting an individual becoming drowsy that includes a wave emitter mounted on an eyeglass frame for emitting a wave along a path directed to pass close to an individual's eyeball without impinging on the eyeball. However, the wave is interrupted by the eyelashes when the eyelid is moving. A detector is disposed on the frame and signaling means are provided to produce an alarm signal at a predetermined time after the last eyelid movement.

Another warning system for warning a user that they have fallen or are about to fall asleep is disclosed in the U.S. Pat. No. 6,087,941 of Ferroz. The system includes a contact lens having a detectable feature such as a hologram or other markings or indicia, metallic substances, color or micro-circuit device which will be worn by the user. The system also includes a detector that detects the presence of the contact lens when the eyelids of the person wearing the contact lens are open. When the eyelids of the user become heavy or closed so as to cover a substantial portion of the detectable feature of the contact lens for a predetermined period, the detector generates a signal to waken the user.

Notwithstanding the above, it is presently believed that there may be a large commercial market for a warning device in accordance with the present invention. There should be a demand for such devices because they are relatively economical to manufacture, relatively durable in use and reliable. Further, such devices enable an individual to use an audible or tactile warning as well as a warning for the driver alone and/or a warning to alert passengers of a potential problem.

BRIEF SUMMARY OF THE INVENTION

In essence the present invention contemplates a warning device for alerting an individual such as a driver of a motor vehicle or operator of dangerous machinery of a tendency to fall asleep. The warning device comprises a pressurized collar that fits around the neck of an individual and underneath the individual's chin. A pressure sensor senses a change in internal pressure in the pressurized collar due to the tilt of the individual's head. For example, when an individual dozes the head will tilt forward and add weight to the collar to thereby increase the internal pressure. An alarm is then activated in response to the change in pressure for alerting the individual of a tendency to fall asleep. The alarm may be audio or tactile such as a mild electrical shock or spray of water to the face.

In a preferred embodiment of the invention, the warning device includes an electrical circuit including a switch, a power source, an electrical shocker capable of emitting a mild shock and a clip adapted to be clipped to an individual's ear. All of the elements mentioned are preferably mounted in a single module that is designed to mount on the ear of an individual.

The invention also contemplates a further embodiment which includes means for detecting a change in the forward aft tilt of an individual's heard. The further embodiment alerts an individual of a tendency to fall asleep in response to a change in the position of an individual's head. In this embodiment of the invention, an electrical circuit includes a source of electrical energy, a shocker capable of producing a small shock, a clip for connecting the shocker to the individual and a source for energizing the shocker by connecting it to the power source when an individual's head is tilted in a forward direction.

The invention will now be described in connection with the accompanying drawings wherein like reference numerals have been used to identify like parts.

DESCRIPTION OF THE PREFERRED EMBODIMENTS OF THE INVENTION

Figure 1:
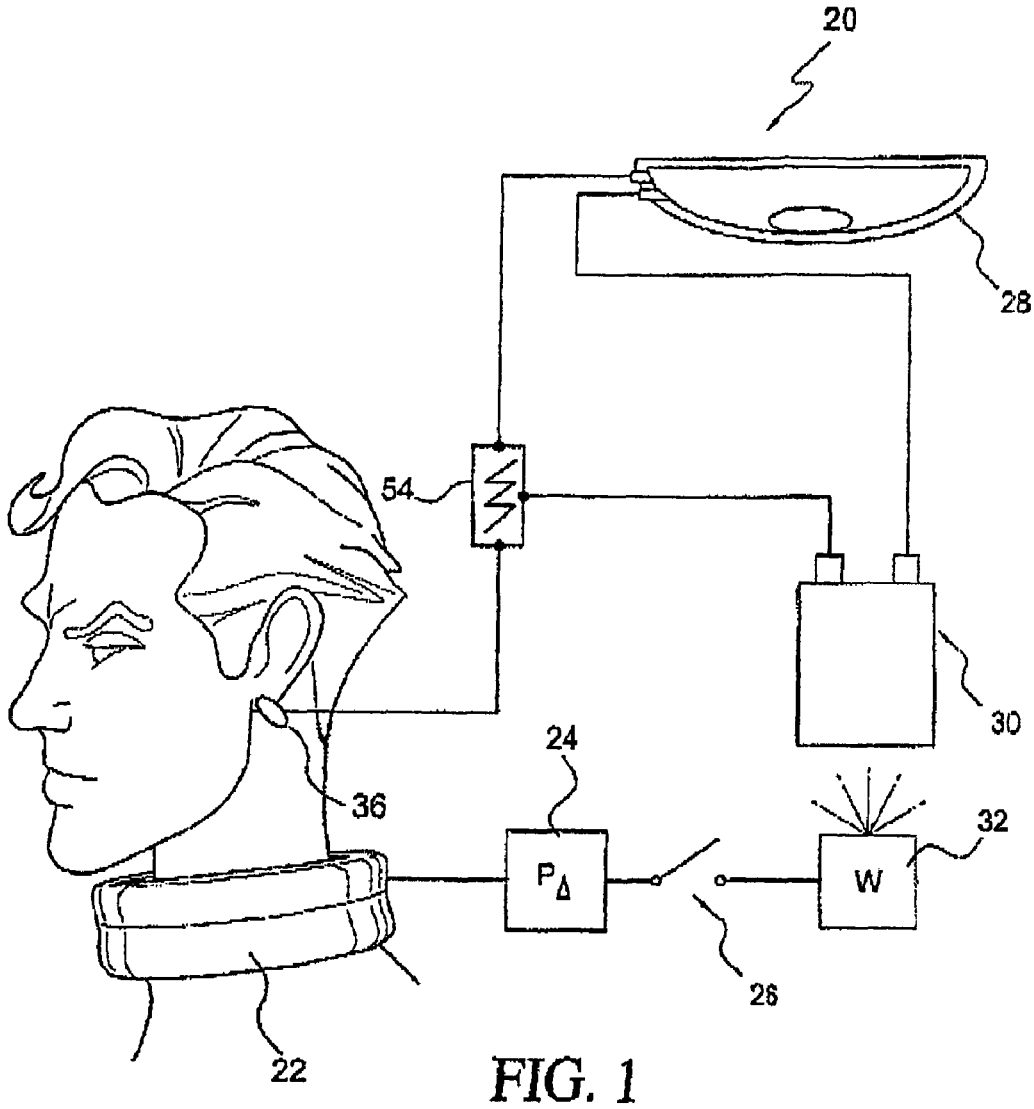
FIG. 1 is a schematic illustration of a first embodiment of the invention.
Figure 2:
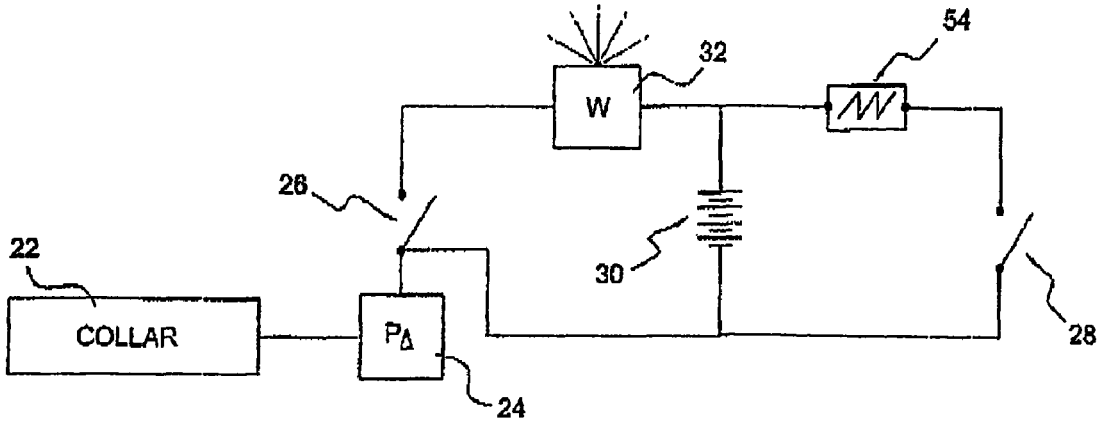
FIG. 2 is a basic circuit for use in a first embodiment of the invention.

A first embodiment of the invention is illustrated in FIGS. 1 and 2. As shown therein, a warning device 20 for alerting an individual such as an operator of a motor vehicle includes a pressurized collar 22 that is adapted to fit around the neck of the individual. A portion of the pressurized collar 22 is disposed under and in close proximity to the individual's chin. Therefore, when the individual starts to nod the chin will rest on the pressurized collar 22 to thereby increase the pressure within the collar 22.

The warning device 20 also includes a pressure sensor 24, a switch 26 and an alarm 32 that is connected to a source of electrical energy such as a battery 30. Therefore, when an individual's chin contacts the collar 22, the sensor 24 detects an increase in pressure and closes the switch 26. Closing the switch 26. Closing the switch 26 connects an alarm 32 to the source of power i.e. battery 30 to activate the alarm 32. The alarm 32 may be an electrical shock, an audible alarm or a water spray. The warning device 20 also includes a mercury switch 28 for detecting the individual's head is tilted when falling asleep to connect a source of power 30 to low electrical shocker 54 for delivery to ear clip 36. It is also anticipated that a mercury switch includes a mercury ball surrounded by a filler having a mass of relatively high density non-conductive liquid compared to air to produce a slight delay action to avoid an alarm if the driver promptly lifts his head after looking down to check the instruments.

Figure 3:
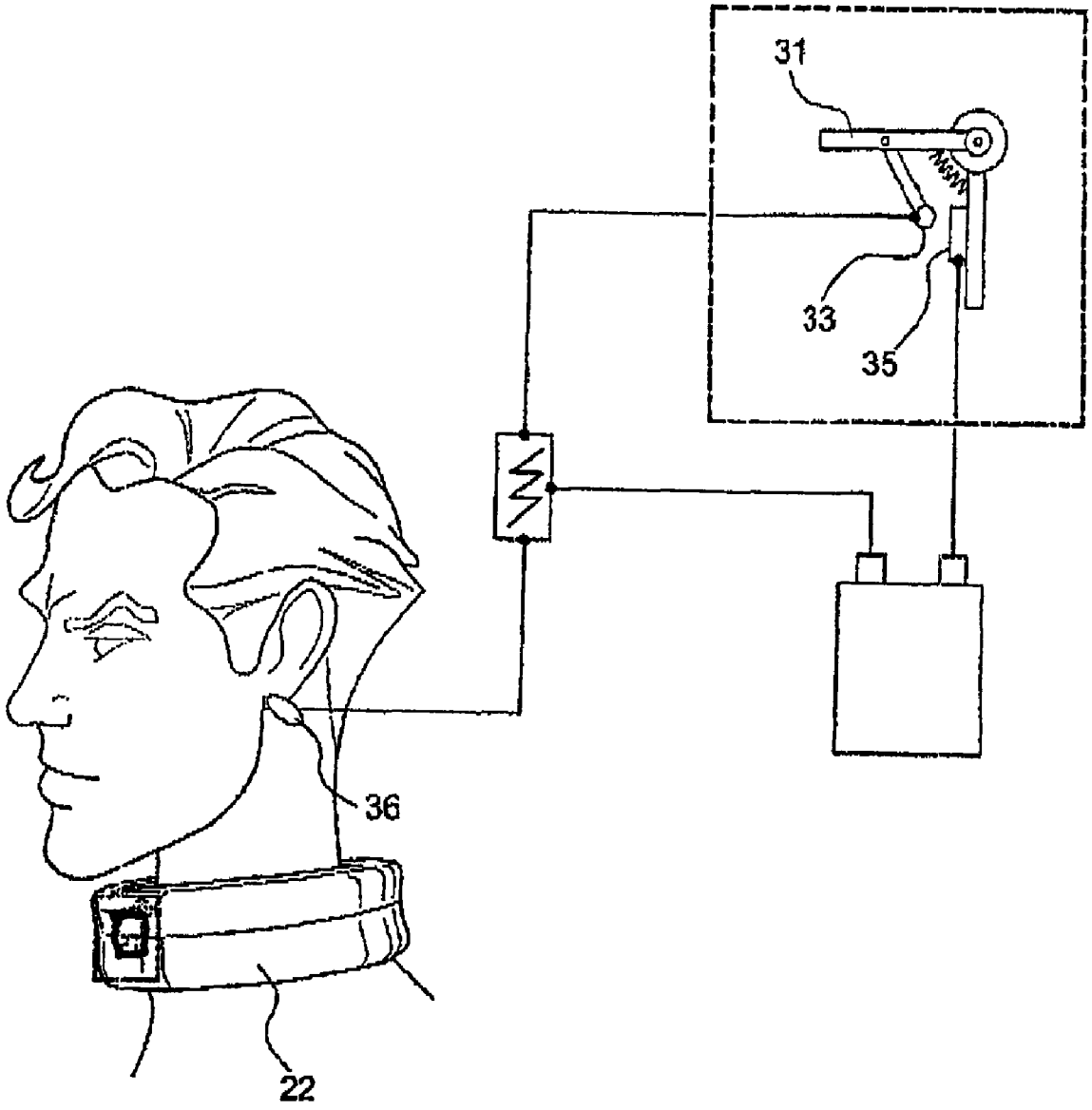
FIG. 3 is a schematic diagram illustrating a second embodiment of the invention.

A second embodiment of the invention is illustrated in FIG. 3 and operates in the same manner as the first embodiment i.e. when the driver nods, the chin will increase the pressure on the collar 22 to depress a lever 31 which brings a contact 33 into contact with a second contact 35 to thereby close the circuit that includes a source of power such as a battery 30. The circuit also includes a low voltage shocker that is connected to the individual as for example by a clip 36 attached to an earlobe to deliver a mild shock. As illustrated a weight or spring biases the first contact 33 away from the contact 35. However, when the individual nods again, a mild shock will awaken the individual.

Figure 4:
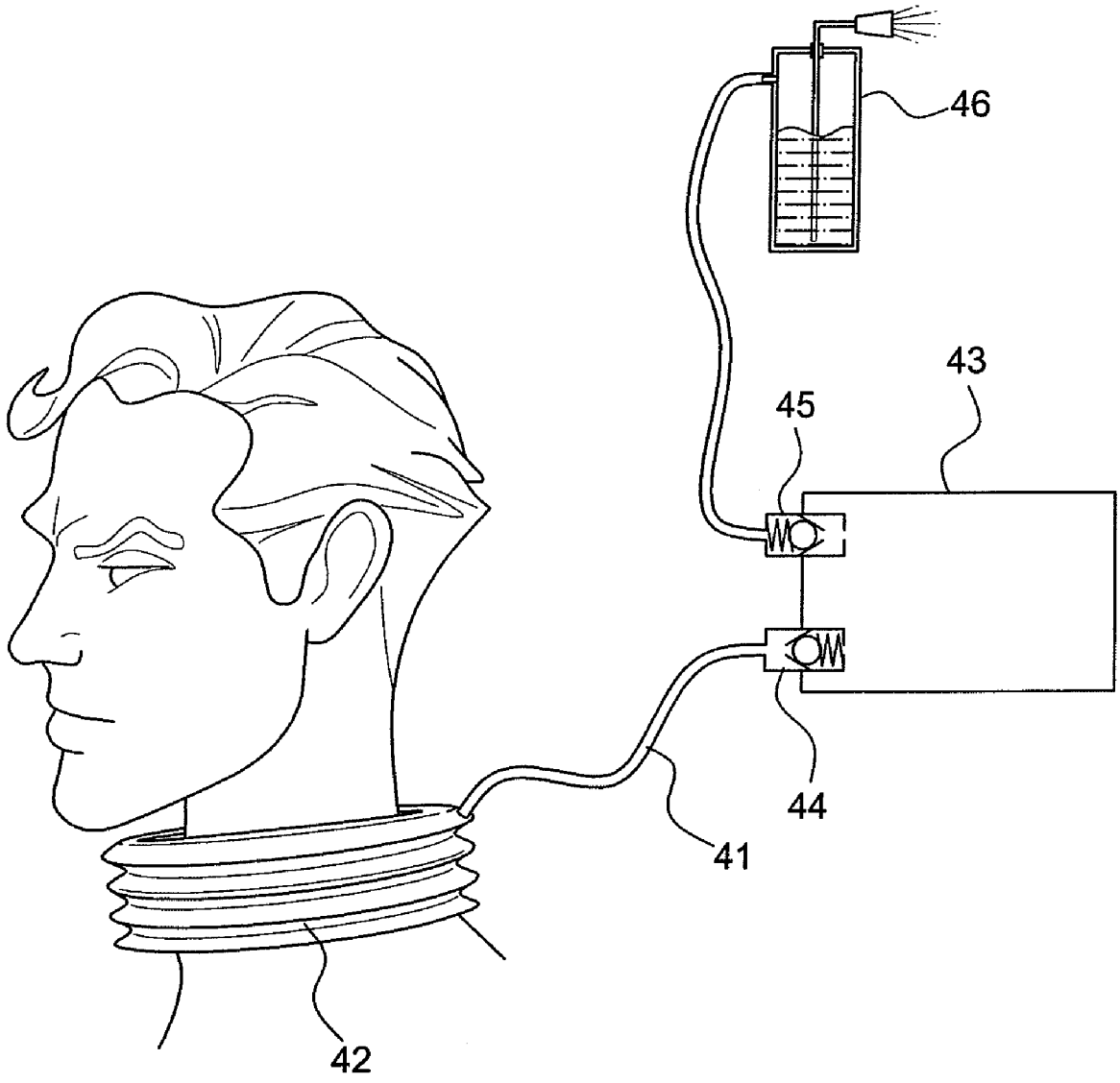
FIG. 4 is a schematic diagram illustrating a third embodiment of the invention.

FIG. 4 illustrates a third embodiment of the invention which operates in a similar manner to the warning devices shown in FIGS. 1, 2, and 3. As illustrated the collar is in the form of a diaphragm 42 which directs air to a cylinder 43 by means of a tube 41 and through a one-way valve 44. Air from the cylinder 43 passes through a second one-way valve 45 and into a water bottle 46 to spray water into the face of the driver.

Figure 5:
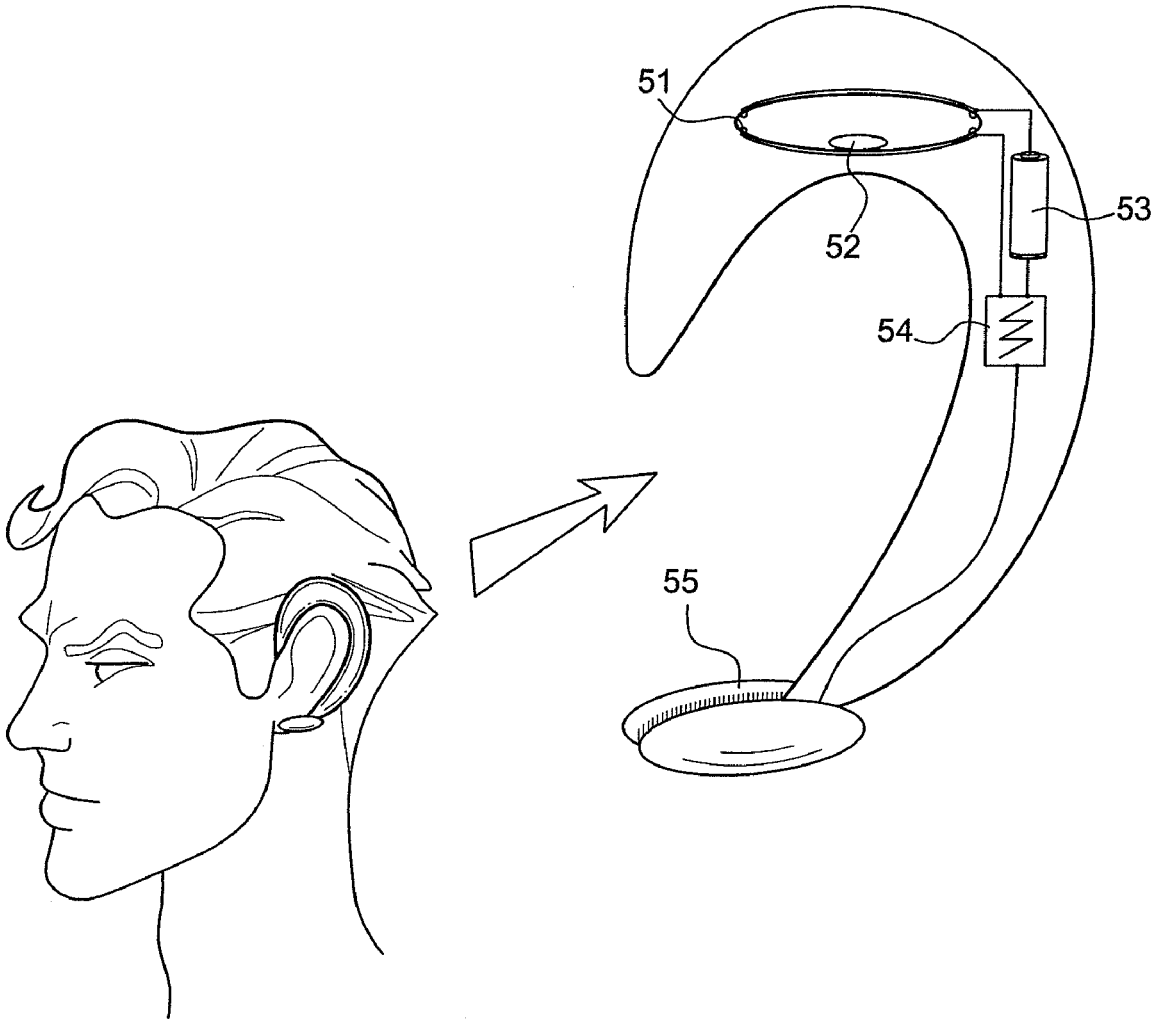
FIG. 5 is a schematic diagram illustrating a fourth embodiment of the invention.

A still further embodiment of the invention is illustrated in FIG. 5 wherein a warning device 50 is incorporated in an ear pod that is adapted to rest on the ear of an individual in the same manner as a number of cell phones. The ear pod includes a switch 51 that is open when in a horizontal position. That is when an individual's head and neck are erect in a normal driving position. As shown schematically, the switch 51 includes an internal conductor 52 that is adapted to slide forward to close the switch 51. From a practical standpoint a properly positioned mercury switch could be used. It is also anticipated that a mercury switch includes a mercury ball surrounded by a filler having a mass of relatively high density non-conductive liquid comparing to air to produce a slight delay in action to avoid an alarm if the driver promptly lifts his head after looking down to check the instruments.

A device 50 also includes an electrical circuit including a battery 53, low electrical shocker 54 and an ear clip 55 for connecting an output of the shocker to the ear of the operator of the motor vehicle.

Figure 6:
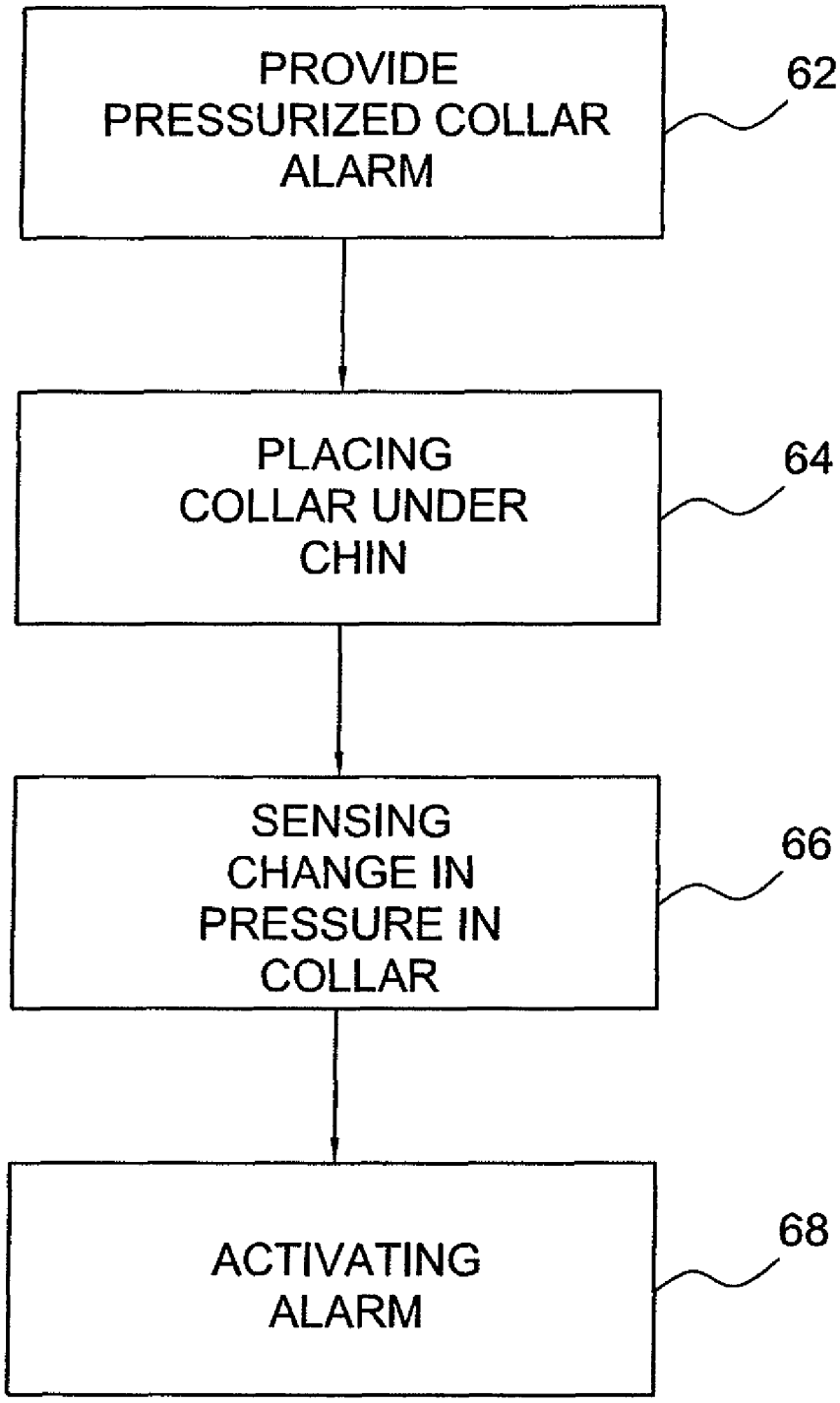
FIG. 6 is a flow chart illustrating a method in accordance with the present invention.

The invention also contemplates a method for alerting an individual of a tendency to fall asleep. As illustrated in FIG. 6, the method for alerting an individual of a tendency to fall asleep includes the step 62 of providing a pressurized collar, a pressure sensor and an alarm. The method also includes the step 64 of placing the collar around an individual's neck with an operable portion of the collar placed under the individual's chin and in close proximity thereto. When the individual nods, the increased pressure on the collar is sensed in step 66 and the alarm is activated in step 68.

The alarm may include a verbal command in a relatively loud voice to alert one or more passengers of the potential for a serious problem. It is also contemplated to provide a first alarm as for example a mild electrical shock and a second alarm as a voice to alert the passengers.

While the invention has been described in connection with its preferred embodiments it should be recognized that changes and modifications may be made therein without departing from the scope of the appended claims.

What is claimed is:

1. A warning device for alerting an individual of a tendency to fall asleep, said warning device comprising:

a pressurized collar adapted to fit around the neck of the individual with a portion of the pressurized collar in the form of a diaphragm under the chin of and in close proximity to the chin of the individual for detecting a change in the forward/aft tilt of the individual's head;

a pressure sensor for sensing a change in the internal pressure of said pressurized collar due to the tilt of the individual's head; and an alarm for alerting the individual of the tendency to fall asleep in response to said change in the forward/aft tilt of the individual's head; and in which said warning device includes an electrical circuit having a power source, a mild shocker, a clip for connecting said shocker to an ear of the individual and a mercury switch for connecting said shocker to said power source when the individual's head tilts forward/aft to thereby warn the individual that they are falling asleep; and wherein said mercury switch includes a mercury ball surrounded by a filler having a mass of relatively high density non-conductive liquid comparing to air to produce a slight delay action to avoid an alarm if the individual promptly lifts his/her head after looking down to check the instruments.

2. A warning device for alerting an individual of a tendency to fall asleep according to claim 1 which includes an audible alarm and means for activating the audible alarm for alerting a passenger in a motor vehicle of a drivers tendency to fall asleep.

3. A warning device for alerting an individual of a tendency to fall asleep according to claim 1 in which the alarm is a water bottle with a sprayer directed toward the face of an individual and wherein activating the alarm directs air from said diaphragm into said water bottle to spray water into the face of the individual.

* * * * *